US005970441A

United States Patent [19]

Mekuria

[11] Patent Number: 5,970,441

[45] Date of Patent: Oct. 19, 1999

[54] DETECTION OF PERIODICITY INFORMATION FROM AN AUDIO SIGNAL

[75] Inventor: Fisseha Mekuria, Lund, Sweden

[73] Assignee: Telefonaktiebolaget LM Ericsson, Stockholm, Sweden

[21] Appl. No.: 08/917,224

[22] Filed: Aug. 25, 1997

[51] Int. Cl.[6] ..... G10L 7/00

[52] U.S. Cl. ..... 704/207; 704/233

[58] Field of Search ..... 704/207, 208, 704/205, 214, 206, 209, 210, 215, 228, 227, 226, 229, 225, 233, 219

[56] References Cited

U.S. PATENT DOCUMENTS

| | | | |
|---|---|---|---|
| 3,600,516 | 8/1971 | King, Jr. | 704/207 |
| 3,617,636 | 11/1971 | Ogihara | 704/207 |
| 3,920,907 | 11/1975 | Mullen, Jr. | 704/200 |
| 4,015,088 | 3/1977 | Dubnowski et al. | 704/208 |
| 4,074,069 | 2/1978 | Tokura et al. | 704/208 |
| 4,164,626 | 8/1979 | Fette | 704/208 |
| 4,468,804 | 8/1984 | Kates et al. | 704/265 |
| 4,589,131 | 5/1986 | Horvath et al. | 704/214 |
| 4,630,304 | 12/1986 | Borth et al. | 381/94.3 |
| 4,731,846 | 3/1988 | Secrest et al. | 704/207 |
| 4,802,225 | 1/1989 | Patterson | 704/207 |
| 4,809,334 | 2/1989 | Bhaskar | 704/207 |
| 4,850,022 | 7/1989 | Honda et al. | 704/207 |
| 4,918,734 | 4/1990 | Muramatsu et al. | 704/214 |
| 4,959,865 | 9/1990 | Stettiner et al. | 704/233 |
| 5,007,093 | 4/1991 | Thomson | 704/214 |
| 5,012,517 | 4/1991 | Wilson et al. | 704/207 |
| 5,012,519 | 4/1991 | Adlersberg et al. | 704/226 |
| 5,127,053 | 6/1992 | Koch | 704/207 |
| 5,276,765 | 1/1994 | Freeman et al. | 704/200 |
| 5,410,632 | 4/1995 | Hong et al. | 704/233 |

(List continued on next page.)

FOREIGN PATENT DOCUMENTS

| | | | |
|---|---|---|---|
| 0490740 A1 | 6/1992 | European Pat. Off. | G01L 3/00 |
| 0722165 A2 | 7/1996 | European Pat. Off. | G01L 9/14 |

OTHER PUBLICATIONS

Lawrence R. Rabiner, et al., "Digital Processing of Speech Signals", published by Prentice–Hall Inc., 1978, pp. 150–158.

Steven F. Boll, "Speech Enhancement in the 1980's: Noise Suppression with Pattern Matching"; *Advances in Speech Signal Processing,* Marcel Dekker, Inc., 1992, chapter 10, pp. 309–325.

Peter Händel, "Low–Distortion Spectrtal Subtraction for Speech Enhancement", European Conference on Speech Communication and Technology, Sep. 1995, pp. 1549–1552.

Andrew Varga, et al., "Noise Compensation Algorithms for use with Hidden Markov Model Based Speech Recognition", Proceedings of ICASSP–88, vol. 1, 1988, pp. 481–484.

Steven F. Boll, "Suppression of Acoustic Noise in Speech Using Spectral Subtraction", IEEE Transaction on Acoustic, Speech, and Signal Processing, vol. ASSP–27, No. 2, Apr. 1979, pp. 113–120.

(List continued on next page.)

*Primary Examiner*—Richemond Dorvil
*Attorney, Agent, or Firm*—Burns, Doane, Swecker & Mathis, L.L.P.

[57] ABSTRACT

A waveform-based technique for generating periodicity information from an input signal includes generating a pre-processed signal by applying low pass and non-linear filtering to the input signal, wherein the pre-processed signal has highlighted speech pitch tracks. An adaptive threshold algorithm is applied to the pre-processed signal to generate a detection signal having waveform segments whose peaks are separated by a pitch period of the input signal. A period between peaks in the detection signal is determined that indicates the periodicity information. Information about the period between the peaks in the detection signal is then used to adapt a scaling value to be used by the adaptive threshold algorithm in a subsequent step. The periodicity information may be utilized in a voice activity detector in a telephonic communications system.

26 Claims, 3 Drawing Sheets

U.S. PATENT DOCUMENTS

| | | | |
|---|---|---|---|
| 5,448,679 | 9/1995 | McKiel, Jr. | 704/208 |
| 5,459,814 | 10/1995 | Gupta et al. | 704/223 |
| 5,473,727 | 12/1995 | Nishiguchi et al. | 704/222 |
| 5,517,595 | 5/1996 | Kleijn | 704/205 |
| 5,519,166 | 5/1996 | Furuhashi et al. | 84/603 |
| 5,548,680 | 8/1996 | Cellario | 704/219 |
| 5,768,473 | 6/1998 | Eatwell et al. | 704/200 |

OTHER PUBLICATIONS

"European Digital Cellular Telecommunications System (Phase 2); Full Rate Speech Transcoding (GSM 06.10)", European Telecommunications Standards Institute, Sep. 1994, ETS 300 580–2, 96 pages.

"European Digital Cellular Telecommunications System (Phase 2); Discontinuous Transmission (DTX) for Full Rate Speech Traffic Channel (GSM 06.31)", European Telecommunications Standards Institute, Sep. 1994, ETS 300 580–5, 15 pages.

Wolfgang J. Hess, "Time–Domain Pitch Period Extraction of Speech Signals Using Three Nonlinear Digital Filters", ICASSP 79. 1979 IEEE International Conference on Acoustics, Speech and Signal Processing, Washington, DC, USA, Apr. 2–4, 1979, New York, New York, USA, IEEE, USA, pp. 773–776.

N. Tsakalos, et al., "Threshold–Based Magnitude Difference Function Pitch Determination Algorithms", International Journal of Electronics, vol. 71, No. 1, Jul. 1991, pp. 13–28.

DETECTION OF PERIODICITY INFORMATION FROM AN AUDIO SIGNAL

BACKGROUND

The present invention relates to pitch period (periodicity) detection, and more particularly to a periodicity detector for use in voice activity detection.

Voice Activity Detection (VAD) is the art of detecting the presence of speech activity in noisy audio signals that are supplied to a microphone of a communication system. VAD systems are used in many signal processing systems for telecommunication. For example, in the Global System for Mobile communication (GSM), traffic handling capacity is increased by having the speech coders employ VAD as part of an implementation of the Discontinuous Transmission (DTX) principle, as described in the GSM specifications (particularly in GSM 06.10—fullrate speech transcoding; and in GSM 06.31—Discontinuous Transmission (DTX) for full rate speech traffic channel, May 1994). In noise suppression systems, such as in spectral subtraction based methods, VAD is used for indicating when to start noise estimation (and noise parameter adaptation). In noisy speech recognition, VAD is also used to improve the noise robustness of a speech recognition system by adding the right amount of noise estimate to the reference templates.

Next generation GSM handsfree functions are planned that will integrate a noise reduction algorithm for high quality voice transmission through the GSM network. A crucial component for a successful background noise reduction algorithm is a robust voice activity detection algorithm. The GSM-VAD algorithm has been chosen for use in the next generation hands-free noise suppression algorithms to detect the presence or absence of speech activity in the noisy audio signal coming from the microphone. If one designates s(n) as a pure speech signal, and v(n) as the background noise signal, then the microphone signal samples, x(n), during speech activity will be:

$$x(n)=s(n)+v(n), \tag{I}$$

and the microphone signal samples during periods of no speech activity will be:

$$x(n)=v(n). \tag{II}$$

The detection of states (I) and (II) described in the above equations is not trivial, especially when the speech/noise ratio (SNR) values of x(n) are low, such as occur in a car environment while driving on a highway.

The GSM VAD algorithm generates information flags indicating which state the current frame of audio signal is classified in. Detection of the above two states is useful in spectral subtraction algorithms, which estimate characteristics of background noise in order to improve the signal to noise ratio without the speech signal being distorted. See, for example, S. F. Boll, "Suppression of Acoustic Noise in Speech Using Spectral Subtraction", *IEEE Trans. on ASSP*, pp. 113–120, vol. ASSP-27 (1979); J. Makhoul & R. McAulay, *Removal of Noise From Noise-Degraded Speech Signals*, National Academy Press, Washington, D.C. (1989); A. Varga, et al., "Compensation Algorithms for HMM Based Speech Recognition Algorithms", *Proceedings of ICASSP-88*, pp. 481–485, vol. 1 (1988); and P. Händel, "Low Distortion Spectral Subtraction for Speech Enhancement", *Proceedings of EUROSPEECH Conf.*, pp. 1549–1553, ISSN 1018–4074 (1995).

The GSM VAD algorithm in turn utilizes an autocorrelation function (ACF) and periodicity information obtained from a speech coder for its operation. As a consequence, it is necessary to run the speech coder before getting any noise-suppression performed. This situation is illustrated in FIG. 1. The digitized microphone signal samples, x(k), are supplied to a speech coder 101, which in turn generates autocorrelation coefficients (ACF) and long term predictor lag values (pitch information), $N_p$, as specified by GSM 06.10. The ACF and $N_p$ signals are supplied to a VAD 103. The VAD 103 generates a VAD decision that is supplied to one input of a spectral subtraction-based adaptive noise suppression (ANS) unit 105. A second input of the ANS 105 receives a delayed version of the original microphone signal samples, x(n). The output of the ANS 105 is a noise-reduced signal that is then supplied to a second speech coder 107. (The second speech coder 107 is shown as a separate unit. However, it will be recognized that the first and second speech coders 101, 107 may physically be the same unit that is run twice.)

From the above discussion, it is apparent that the GSM VAD algorithm requires the execution of the whole speech coder in order to be able to extract the short term autocorrelation and long term periodicity information that is necessary for making the VAD decision.

The periodicity information in the speech coder is calculated by a long term predictor using cross correlation algorithms. These algorithms are computationally expensive and incur unnecessary delay in the hands-free signal processing. The requirement for a simple periodicity detector gets more acute with the next generation codecs (such as GSM's next generation Enhanced Full Rate (EFR) codec) because it consumes a large amount of memory and processing capacity (i.e., the number of instructions that need to be performed per second) and because it adds a significant computational delay compared to GSM's current Full Rate (FR) codecs.

The utilization of the periodicity and ACF information from the speech coder 101 for use by the VAD decision in the noise reduction algorithm is a costly method with respect to delay, computational requirements and memory requirements. Furthermore, the speech coder has to be run twice before a successful voice transmission is achieved. The extraction of periodicity information from the signal is the most computationally expensive part. Consequently, a low complexity method for extracting the periodicity information in the signal is needed for efficient implementation of the background noise suppression algorithm in the mobile terminals and accessories of the future.

Conventional periodicity detectors, such as those described in U.S. Pat. Nos. 3,920,907 and 4,164,626, are primarily based on analog processing of the signals, and fail to take into account the problems of material fading and slow processing time. Furthermore, the computationally expensive techniques described in these patents are designed to process input signals that consist only of clean signals with no additive noise.

Other conventional periodicity detectors, such as those described in U.S. Pat. Nos. 5,548,680; 4,074,069; and 5,127,053, use the standard GSM type pitch detectors based on linear predictive coding (LPC) modelling of the input signal. These techniques, which suffer from the problems identified above, also fail to adapt the processing to the time varying nature of the signal, but instead use estimation model parameters (like the LPC order, frame length, and the like) that are not time-varying.

SUMMARY

It is therefore an object of the present invention to provide a periodicity detection method and apparatus that is based on adaptive signal processing, is computationally very simple, and which does not make any a priori assumptions about the signal (i.e., whether it is noisy or clean or correlated).

In accordance with one aspect of the present invention, the foregoing and other objects are achieved in a method and apparatus for generating periodicity information from an input signal. The technique includes generating a pre-processed signal by applying low pass and non-linear filtering to the input signal, wherein the pre-processed signal has highlighted speech pitch tracks. An adaptive threshold algorithm is applied to the pre-processed signal to generate a detection having waveform segments whose peaks are separated by a pitch period of the input signal. The period between peaks in the detection signal is then determined to generate the periodicity information. Information about the period between the peaks in the detection signal is then used to adapt a scaling value to be used by the adaptive threshold algorithm in a subsequent step. The periodicity information may be utilized in a voice activity detector in a telephonic communications system.

In another aspect of the invention, the non-linear filtering is performed in accordance with the following equation:

$$y(k) = \begin{cases} \beta * x^n(k) & \text{if } x(k) \geq 0 \\ 0 & \text{if } x(k) < 0 \end{cases}$$

wherein y(k) is a kth sample of the low pass filtered input signal. Values for n and β may be selected as a function of the signal to noise ratio of the input signal.

In still another aspect of the invention, the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a signal that was generated by a previously performed adaptive threshold computation step.

In still another aspect of the invention, the scaling factor, G(i), is adjusted as a function of the value N(i).

In yet another aspect of the invention, the step of adjusting the scaling factor, G(i), comprises the steps of comparing N(i) to a predetermined value, and increasing G(i) if N(i) is less than the predetermined value and decreasing G(i) if N(i) is greater than the predetermined value. The predetermined value may be, for example, an expected average pitch period for a speech signal.

BRIEF DESCRIPTION OF THE DRAWINGS

The objects and advantages of the invention will be understood by reading the following detailed description in conjunction with the drawings in which.

DETAILED DESCRIPTION

Figure 1:
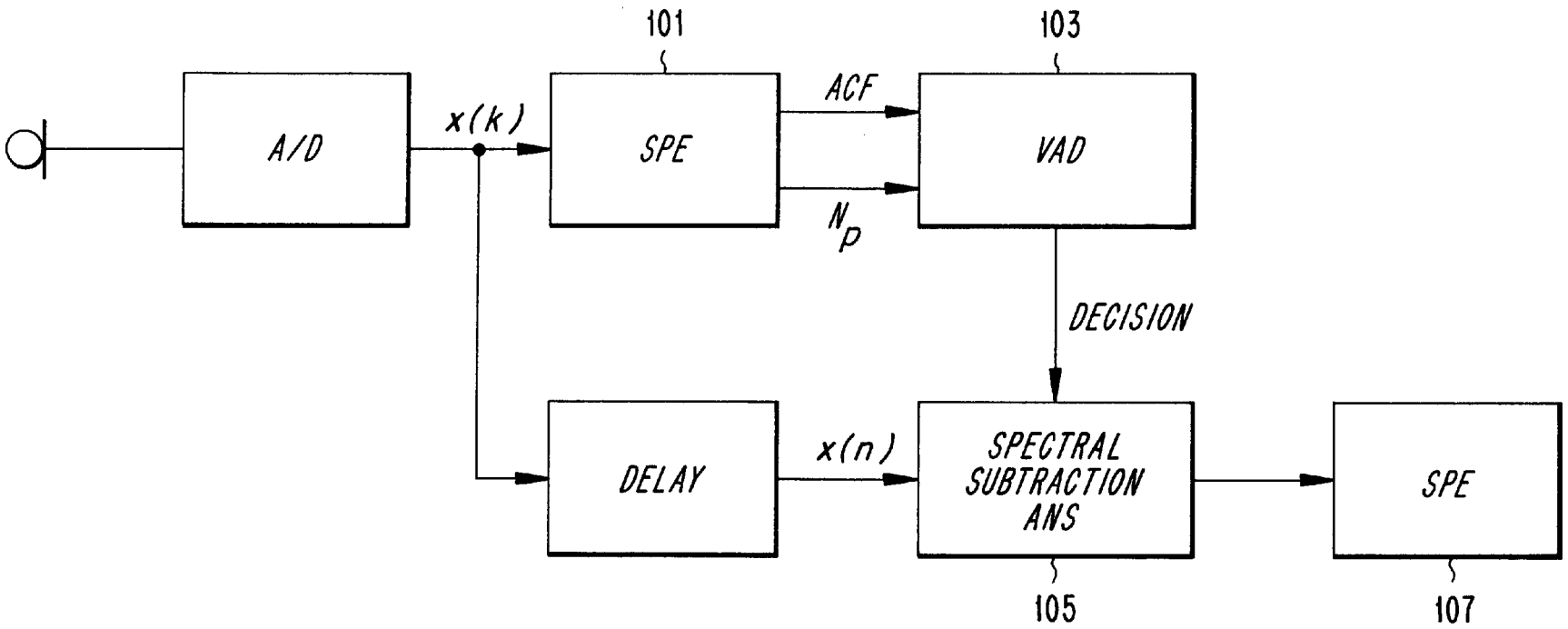
FIG. 1 (PRIOR ART)
FIG. 1 is a block diagram of a conventional voice activity detection scheme.

The various features of the invention will now be described with respect to the figures, in which like parts are identified with the same reference characters.

The invention provides a low complexity waveform-based periodicity detector that eliminates the requirement for running the entire speech coder merely for the purpose of obtaining the signal periodicity information (i.e., the long term predictor lag values, $N_p$, described in GSM 06.10). A voice activity detector can instead operate on $N_p$ values that are obtained by the inventive periodicity detector, plus ACF values that are obtained by computational routines that are already being run in the adaptive noise suppression unit. (That is, conventional spectral subtraction-based adaptive noise suppression algorithms contain ACF computation as part of their signal processing. The ACFs are calculated by off-the-shelf standard algorithms which are fully described in many signal processing textbooks, so they need not be described here in detail.) This makes the entire implementation efficient in both memory usage and in processing delay.

Figure 2:
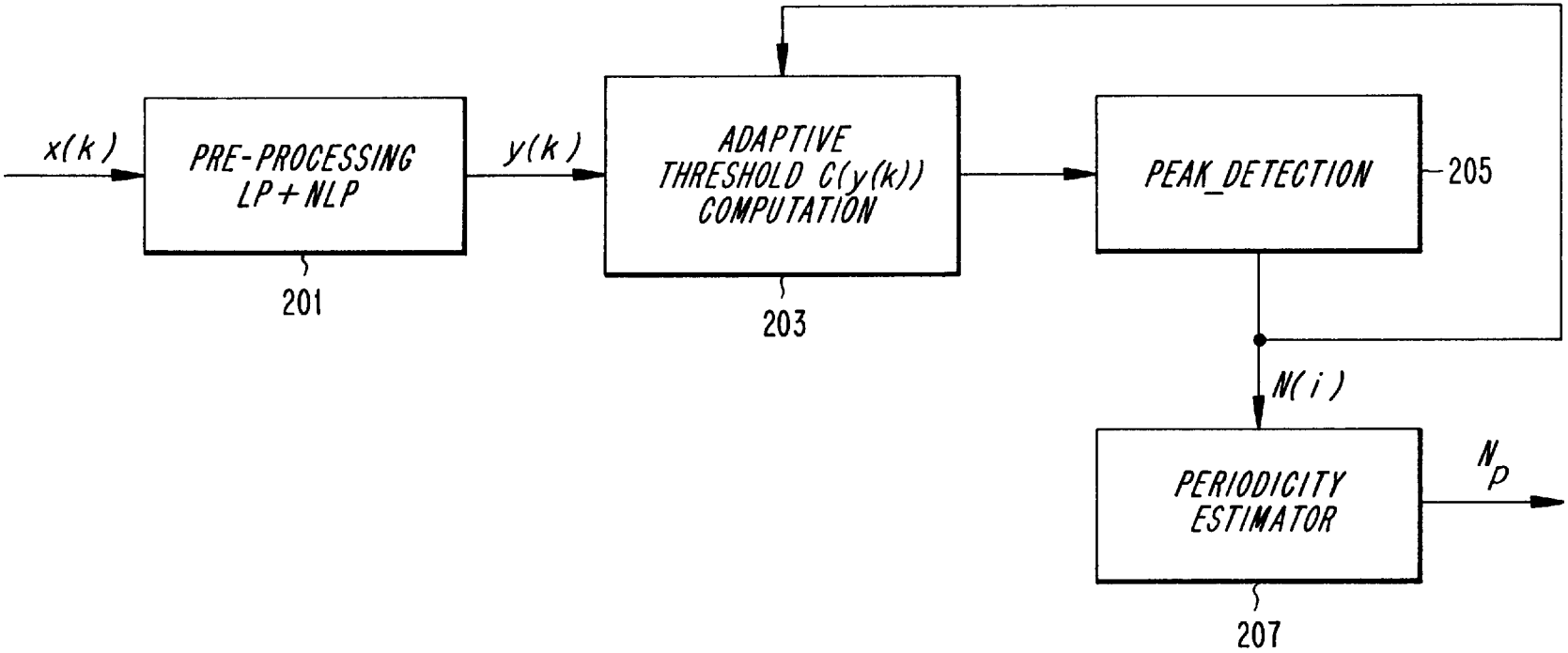
FIG. 2 is a block diagram of a periodicity detector in accordance with the invention.

An exemplary embodiment of the inventive periodicity detector is shown in FIG. 2. A system as shown in FIG. 2 could, for example, be implemented by a programmable processor running a program that has been written in C-source code or assembler code. In accordance with one aspect of the invention, periodicity detection is based on a short time waveform pitch computation and long time pitch period comparison. Referring now to FIG. 2, the discrete audio signal, x(k), is first run through a pre-processing stage 201 composed of a low pass filter (LP) and non-linear signal processing block (NLP) to highlight the speech pitch tracks. The purpose of the LP filter is to extract the pitch frequency signals from the noisy speech. Since pitch frequency signals in speech are found in the range of 200–1000 Hz, the LP filter cutoff frequency range is preferably chosen to be in the range of 800–1200 Hz.

The non-linear processing function is preferably in accordance with the following equation:

$$y(k) = \begin{cases} \beta * x^n(k) & \text{if } x(k) \geq 0 \\ 0 & \text{if } x(k) < 0 \end{cases}$$

The values for n and β are preferably selected from a look-up table as a function of the signal to noise ratio (SNR) of the noisy input signal. The SNR could be measured in the pre-processing stage 201 and the fixed table values may be determined from empirical experiments. For low SNR values (e.g., 0–6 dB in a car environment), a larger value of n is used to enhance the peaks while a lower value of β is used to avoid overflow during computation. For high SNR values, the reverse strategy applies (i.e., lower values of n and higher values of β are used).

Figure 3A:
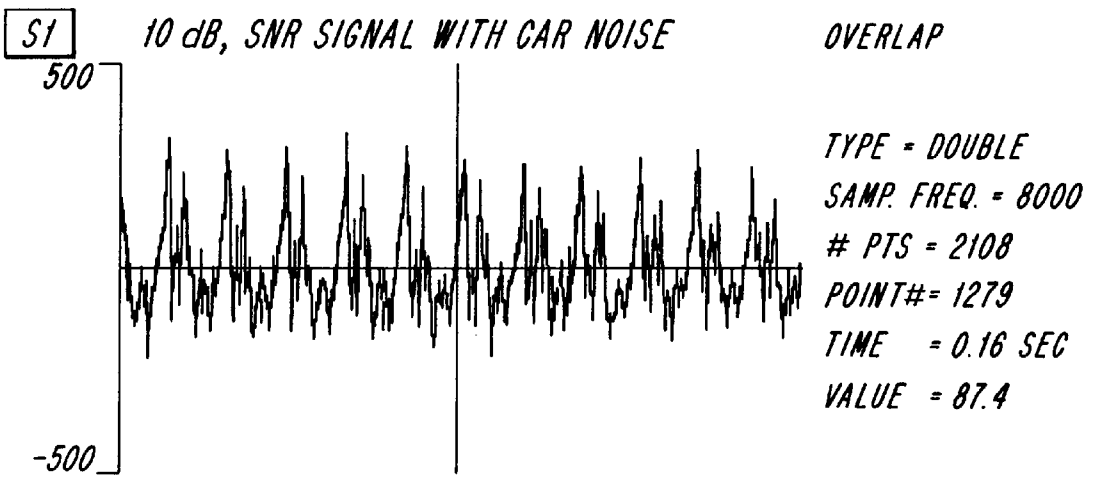
FIGS. 3*a* and 3*b* illustrate, respectively, a signal including speech information and car noise, and a resultant signal from a pre-processing stage in accordance with one aspect of the invention.
Figure 3B:
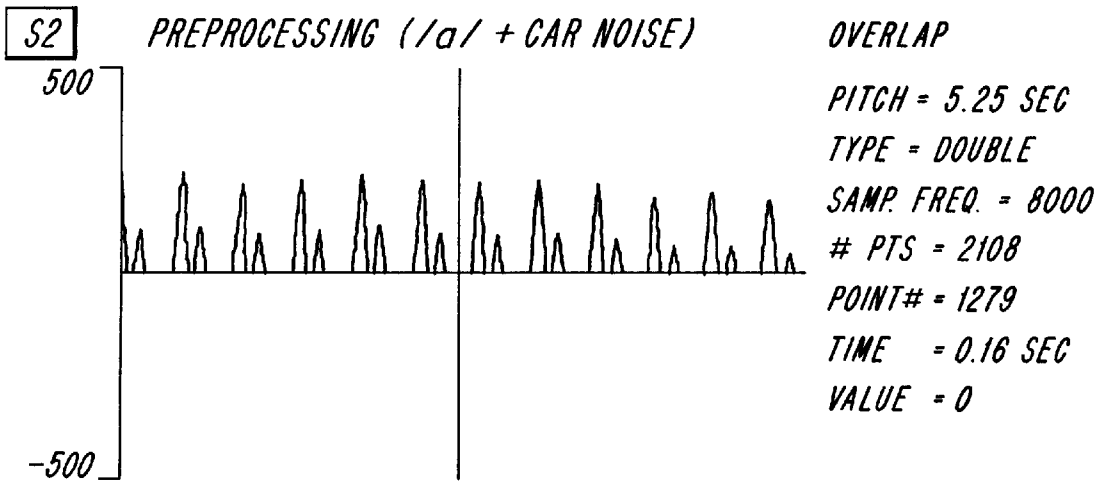

FIGS. 3*a* and 3*b* illustrate the results of the pre-processing stage 201. In FIG. 3*a*, a 10 dB SNR signal, S1, with car noise is shown. In FIG. 3*b*, a resultant signal, S2, is shown that is the result of pre-processing the first signal S1 in accordance with the invention. In this example, the average pitch period is 5.25 seconds and is constant within one sample period.

The pre-processing stage 201 simplifies the subsequent periodicity detection and increases robustness. The output of the pre-processing stage 201 is supplied to an adaptive threshold computation stage 203, whose output is in turn supplied to a peak detection stage 205. The adaptive threshold computation stage 203 and peak detection stage 205 detect waveform segments containing periodicity (pitch) information. The purpose of the adaptive threshold computation stage 203 is to suppress those peaks in the preprocessed signal that do not contain information about the pitch period of the input signal. Thus, those portions of the preprocessed signal having a peak magnitudes below an adaptively determined threshold are suppressed. The output of the adaptive threshold computation stage 203 should have peaks that are spaced apart by the pitch period. The job of the peak detection stage 205 is to determine the number of samples between peaks in the signal that is provided by the adaptive threshold computation stage 203. This number of samples, designated as N, constitutes a frame of information.

The adaptive threshold computation stage 203 generates an output, C(y(k)), in accordance with the following equation:

$$C(y(k)) = \begin{cases} y(k) & \text{if } y(k) \geq V_{th}(i) \\ 0 & \text{if } y(k) < V_{th}(i) \end{cases}$$

It can be seen that for samples of y(k) whose magnitude exceeds the magnitude of the threshold value $V_{th}(i)$, the adaptive threshold computation stage 203 generates an output equal to the input y(k). For samples of y(k) whose magnitude is less than the magnitude of the threshold value $V_{th}(i)$, the output is zero. In a preferred embodiment, C(y(k)) is always a positive value because the output of the preprocessing stage 201, y(k), is itself always positive.

The threshold level, $V_{th}(i)$ is preferably generated from the input y(k) values in accordance with the following equation:

$$V_{th}(i) = \frac{G(i)}{N(i)} \sum_{k=0}^{N(i)-1} y(k)$$

where G(i) is a scaling factor at time i, and N(i) is the frame length of frame i. The values N(i), G(i) and, consequently, $V_{th}(i)$ vary from frame to frame as a function of the noisy input signal's magnitude and spectral non-stationarity (i.e., the degree to which the probability density function (pdf) of the signal changes over time). For each frame, the value of N(i) is provided as a feedback signal from the peak detection stage 205. The value of G(i) is adjusted according to a look-up table as a function of changes in N(i). The fixed G(i) table values are determined empirically. Generally, they take on values between 0 and 1, and react inversely to changes in N(i). For the first frame, a guessed value of G(0) may be used. Subsequently, the feedback values of N(i) may be compared with an expected average pitch period for speech signals (e.g., a number of samples corresponding to 20 msec). Then, if the value of N(i) is greater than the expected average value, the value of G(i) is decreased. Similarly, if the value of N(i) is less than the expected average value, then the value of G(i) is increased. In this way, the output of the adaptive threshold computation stage 203 is adaptively adjusted so that peaks of the input signal that do not contain the pitch period information are suppressed without also affecting parts of the signal that do contain the pitch period information. This adaptive tracking of signal information is a significant factor in achieving robust periodicity detection.

As stated above, the peak detection stage 205 receives the C(y(k)) values from the adaptive threshold computation stage 203, and measures the period between detected peaks. The output, N(i), of the peak detection stage 205, is the number of samples between the detected peaks.

The output of the peak detection stage 205 is supplied to a periodicity estimate stage 207, which generates the periodicity information, $N_p$, by averaging several (e.g., three or four) values of N(i), and checking whether the values of $N_p$ are close to expected average values of pitch period. In an alternative embodiment of the invention, the periodicity estimate stage 207 also checks the individual values of N(i) in order to avoid using an erroneous value that will detrimentally affect the average periodicity estimate $N_p$.

A waveform-based approach to periodicity detection, having low computation and memory requirements, has been described. Adaptive threshold estimates are used to follow the magnitude and spectral non-stationarity of the speech signal corrupted by noise.

The invention has been described with reference to a particular embodiment. However, it will be readily apparent to those skilled in the art that it is possible to embody the invention in specific forms other than those of the preferred embodiment described above. This may be done without departing from the spirit of the invention. The preferred embodiment is merely illustrative and should not be considered restrictive in any way. The scope of the invention is given by the appended claims, rather than the preceding description, and all variations and equivalents which fall within the range of the claims are intended to be embraced therein.

What is claimed is:

1. A method of generating periodicity information from an input audio signal, comprising the steps of:

generating a pre-processed signal by applying low pass and non-linear filtering to remove information from the input audio signal, wherein the removed information is not indicative of speech pitch information;

transforming the pre-processed signal in accordance with an adaptive threshold algorithm to generate a detection signal having waveform segments whose peaks are separated by a pitch period of the input audio signal;

determining a period between peaks in the detection signal to generate the periodicity information; and using information about the period between the peaks in the detection signal to adapt a scaling value that is used by the adaptive threshold algorithm when processing a subsequent pre-processed signal.

2. The method of claim 1, wherein the non-linear filtering is performed in accordance with the following equation:

$$y(k) = \begin{cases} \beta * x^n(k) & \text{if } x(k) \geq 0 \\ 0 & \text{if } x(k) < 0 \end{cases}$$

wherein y(k) is a kth sample of the low pass filtered input audio signal, β is a value for adjusting magnitude of the pre-processed signal, x(k) is a kth input audio signal, and n is a value for adjusting peaks in the pre-processed signal.

3. The method of claim 2, wherein values for n and β are selected as a function of a signal to noise ratio of the input audio signal.

4. The method of claim 3, wherein the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a signal that was generated by a previously performed adaptive threshold computation step.

5. The method of claim 4, further comprising the step of adjusting the scaling factor, G(i), as a function of the value N(i).

6. The method of claim 5, wherein the step of adjusting the scaling factor, G(i), comprises the steps of:

comparing N(i) to a predetermined value;

increasing G(i) if N(i) is less than the predetermined value; and decreasing G(i) if N(i) is greater than the predetermined value.

7. The method of claim 2, wherein the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a signal that was generated by a previously performed adaptive threshold computation step.

8. The method of claim 7, further comprising the step of adjusting the scaling factor, G(i), as a function of the value N(i).

9. The method of claim 8, wherein the step of adjusting the scaling factor, G(i), comprises the steps of:

comparing N(i) to a predetermined value;

increasing G(i) if N(i) is less than the predetermined value; and decreasing G(i) if N(i) is greater than the predetermined value.

10. The method of claim 1, wherein the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a signal that was generated by a previously performed adaptive threshold computation step.

11. The method of claim 10, further comprising the step of adjusting the scaling factor, G(i), as a function of the value N(i).

12. The method of claim 11, wherein the step of adjusting the scaling factor, G(i), comprises the steps of:

comparing N(i) to a predetermined value;

increasing G(i) if N(i) is less than the predetermined value; and decreasing G(i) if N(i) is greater than the predetermined value.

13. The method of claim 1, wherein the input audio signal is an input speech signal.

14. An apparatus for generating periodicity information from an input audio signal, comprising:

means for generating a pre-processed signal by applying low pass and non-linear filtering to remove information from the input audio signal, wherein the removed information is not indicative of speech pitch information;

means for transforming the pre-processed signal in accordance with an adaptive threshold algorithm to generate a detection signal having waveform segments whose peaks are separated by a pitch period of the input audio signal;

means for determining a period between peaks in the detection signal to generate the periodicity information; and means for using information about the period between the peaks in the detection signal to adapt a scaling value that is used by the adaptive threshold algorithm when processing a subsequent pre-processed signal.

15. The apparatus of claim 14, wherein the non-linear filtering is performed in accordance with the following equation:

$$y(k) = \begin{cases} \beta * x^n(k) & \text{if } x(k) \geq 0 \\ 0 & \text{if } x(k) < 0 \end{cases}$$

wherein y(k) is a kth sample of the low pass filtered input audio signal, β is a value for adjusting magnitude of the pre-processes signal, x(k) is a kth input audio signal, and n is a value for adjusting peaks of the pre-processed signal.

16. The apparatus of claim 15, wherein values for n and β are selected as a function of a signal to noise ratio of the input audio signal.

17. The apparatus of claim 16, wherein the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a previously generated detection signal.

18. The apparatus of claim 17, further comprising means for adjusting the scaling factor, G(i), as a function of the value N(i).

19. The apparatus of claim 18, wherein the means for adjusting the scaling factor, G(i), comprises:

means for comparing N(i) to a predetermined value;

means for increasing G(i) if N(i) is less than the predetermined value; and means for decreasing G(i) if N(i) is greater than the predetermined value.

20. The apparatus of claim 15, wherein the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a previously generated detection signal.

21. The apparatus of claim 20, further comprising means for adjusting the scaling factor, G(i), as a function of the value N(i).

22. The apparatus of claim 21, wherein the means for adjusting the scaling factor, G(i), comprises:

means for comparing N(i) to a predetermined value;

means for increasing G(i) if N(i) is less than the predetermined value; and means for decreasing G(i) if N(i) is greater than the predetermined value.

23. The apparatus of claim 14, wherein the means for transforming the pre-processed signal in accordance with the adaptive threshold algorithm generates a threshold signal $V_{th}(i)$ in accordance with the following equation:

$$V_{th}(i) = \frac{G(i)}{N(i)} \sum_{k=0}^{N(i)-1} y(k)$$

where y(k) is a kth sample of the pre-processed signal, G(i) is a scaling factor at time i, and N(i) is a number of samples between peaks in a previously generated detection signal.

24. The apparatus of claim 23, further comprising means for adjusting the scaling factor, G(i), as a function of the value N(i).

25. The apparatus of claim 24, wherein the means for adjusting the scaling factor, G(i), comprises:

means for comparing N(i) to a predetermined value;

means for increasing G(i) if N(i) is less than the predetermined value; and means for decreasing G(i) if N(i) is greater than the predetermined value.

26. The apparatus of claim 14, wherein the input audio signal is an input speech signal.

* * * * *